US006422181B1

(12) United States Patent
Ovari

(10) Patent No.: US 6,422,181 B1
(45) Date of Patent: Jul. 23, 2002

(54) COOLING SYSTEM WITH ELECTRICALLY ADJUSTABLE CONTROL ELEMENT

(75) Inventor: Zlatko Ovari, Roehrmoos (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 08/942,397

(22) Filed: Oct. 10, 1997

Related U.S. Application Data

(63) Continuation of application No. 08/653,609, filed on May 24, 1996, now abandoned.

(30) Foreign Application Priority Data

May 26, 1995 (DE) ..... 195 19 378

(51) Int. Cl.[7] ..... F02P 7/14
(52) U.S. Cl. ..... 123/41.1
(58) Field of Search ..... 123/41.1

(56) References Cited

U.S. PATENT DOCUMENTS

| | | | | |
|---|---|---|---|---|
| 3,320,501 A | | 5/1967 | Davies | 318/18 |
| 4,895,301 A | | 1/1990 | Kennedy | 236/34.5 |
| 4,930,455 A | * | 6/1990 | Creed et al. | 123/41.1 |

FOREIGN PATENT DOCUMENTS

| | | |
|---|---|---|
| DE | 34 39 438 | 5/1985 |
| DE | 37 05 232 | 9/1988 |
| DE | 43 24 178 A1 | 1/1995 |
| DE | 43 24 178 | 1/1995 |
| DE | 44 09 547 | 1/1995 |
| DE | 43 29 917 | 3/1995 |
| EP | 0 533 498 A1 | 3/1993 |
| JP | 63 008802 A | 1/1988 |

OTHER PUBLICATIONS

"Adaptiver Temperaturregler," Industrie–elektronik + elektronik, Jan. 30, 1985, Nr. 11, pp. 48, 50.

"Adaptive PID–Regler für thermische Prozesse," L. Billmann et al., atp—Automatisierungstechnische Praxis 31, 1989, pp. 327–330.

German Search Report dated Dec. 21, 1995.

* cited by examiner

*Primary Examiner*—Noah P. Kamen
(74) *Attorney, Agent, or Firm*—Crowell & Moring LLP

(57) ABSTRACT

A cooling system for an internal combustion engine according to the invention has an electrically adjustable control element to influence the coolant temperature of the internal combustion engine, and an electronic regulator connected upstream of the control element. The regulator generates a control signal value to control the control element to achieve a set coolant temperature, at least as a function of a quantity influenced by the coolant temperature. The parameters of the regulator are determined adaptively during engine operation by evaluating the step response of the quantity proportional to the actual coolant temperature, to a step excitation of the control element.

14 Claims, 1 Drawing Sheet

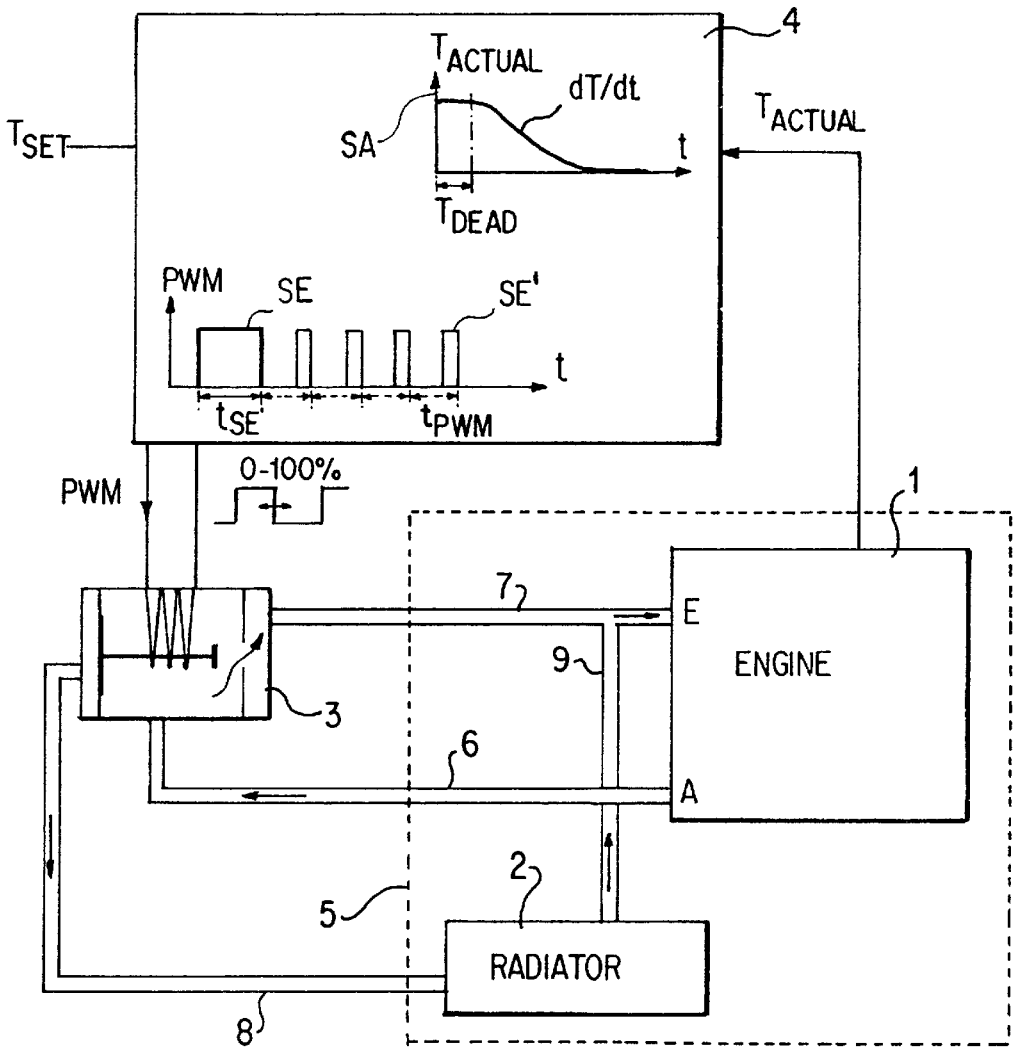
4
$T_{ACTUAL}$
dT/dt
SA
t
$T_{DEAD}$
$T_{SET}$
$T_{ACTUAL}$
PWM
SE
SE'
t
$t_{SE}$
$t_{PWM}$
PWM
0-100%
1
7
E
ENGINE
9
3
6
A
2
5
RADIATOR
8

COOLING SYSTEM WITH ELECTRICALLY ADJUSTABLE CONTROL ELEMENT

This application is a continuation application Ser. No. 08/653,609, filed on May 24, 1996, now abandoned.

BACKGROUND OF THE INVENTION

The invention relates to a cooling system with an electrically adjustable control element for influencing the coolant temperature of an internal combustion engine in a motor vehicle.

A cooling system of this generic type is disclosed, for example, in German patent document DE 43 24 178 A, and corresponding allowed U.S. patent application Ser. No. 08/277,004. This system incorporates a radiator and a thermostatic valve in the form of an electrically adjustable control element, by which the coolant temperature can be regulated during warmup operation, mixed operation, and radiator operation. The electrically adjustable thermostatic valve contains an element composed of expandable material that is electrically heatable to reduce the coolant temperature.

In this known cooling system, the thermostatic valve regulates the flow of coolant between the engine and the radiator so that during warmup operation, the coolant coming from the engine returns through a short circuit, bypassing the radiator. During mixed operation, the coolant coming from the engine returns partly through the radiator and partly through the short circuit, and during radiator operation the coolant coming from the engine returns primarily through the radiator. Electrically heating the electrically adjustable control element enlarges the aperture cross section, allowing more coolant to flow to the radiator compared to an aperture cross section governed by the temperature of the coolant.

Electrical heating of the electrically adjustable control element is performed by a regulating device that detects the actual coolant temperature and compares it with a preset coolant temperature. If the actual coolant temperature detected is above the set coolant temperature, the electrical heating is switched on to cool the coolant. On the other hand, at an actual coolant temperature below the prescribed set coolant temperature the electrical heating of the electrically adjustable control element is switched off.

This known cooling system performs only two-point control by means of a simple comparison of the actual coolant temperature and the set cooling temperature, so that severe underswings and overswings can occur with respect to the set coolant temperature.

Moreover, a cooling system disclosed in German patent document DE 44 03 713 (not published) has an electrically adjustable delivery pump which serves as a control element for influencing the coolant temperature. However, no control strategy is described for this device.

The object of the invention is to provide an improved cooling system of the type described above, which prevents underswings and/or overswings relative to the preset coolant temperature; and reaches the preset coolant temperature as quickly as possible.

This object is achieved by the cooling system according to the invention in which a known PID (Proportional-Integral-Derivative) feedback control is used to regulate the electrically adjustable thermostatic valve to achieve optimum control of the coolant temperature. The parameters for the regulating device are determined adaptively during engine operation by evaluating the response of a value proportional to the actual coolant temperature, to a step excitation input to the control element.

It has been found in tests that a PID regulator is especially suitable for regulating a cooling system with an electronically or electrically adjustable control element to regulate the coolant temperature of internal combustion engines so as to reach the preset coolant temperature as quickly as possible. A PID regulator of this kind is well known to those skilled in the art, and can be of either analog or digital design. It can be integrated for example into an electronic control device, (which is provided in any case), for controlling the cooling system and/or the engine. Particularly when using a digital PID regulator, the costs and effort for a cooling system according to the invention are slight, despite improved regulation. The use of PID control units for feedback control applications has long been known to those skilled in the field of control engineering. However, the regulator can also be another type of known electronic regulator, for example a $PI_nD_n$, or a PI regulator.

It should also be noted that the parameter influenced by the coolant temperature (or the value that is proportional to the actual coolant temperature) can also be the (actual) coolant temperature itself.

The regulator according to the invention simulates the relationship between the input of the control element and the output of the cooling system. The parameters of the regulator are automatically adjusted to take account of all the parameters that affect in this relationship, such as vehicle speed, outside temperature, engine load, vehicle interior heating, the state of the air conditioning system, the rpm of the radiator fan, and/or temperature acquisition subject to dead time as well as the inertia and nonlinearity of the control element. Additional sensors to detect these parameters are thus not required, so that not only optimum regulation, but also additional cost savings are achieved.

In one advantageous embodiment of the invention, step excitation is performed by the control signal value to control the control element itself. Assuming that the control signal value contains at least a partial step signal component, according to the invention a self-test signal does not have to be generated as a step excitation to determine the step response. Preferably the step response is evaluated when a predetermined operating condition prevails.

In another advantageous embodiment of the invention, the control signal value is pulse-width-modulated. Pulse-width-modulated signals permit finely tuned control of the control signal, and frequently a step excitation is automatically available to evaluate a step response.

Other objects, advantages and novel features of the present invention will become apparent from the following detailed description of the invention when considered in conjunction with the accompanying drawings.

BRIEF DESCRIPTION OF THE DRAWINGS

The single FIGURE of the drawing shows an embodiment of a cooling system according to the invention, with an electrically heatable thermostatic valve as the electrically adjustable control element.

DETAILED DESCRIPTION OF THE DRAWING

Referring to the Figure, an output A of the cooling system of an engine 1 is connected by a coolant conducting line 6 with an input of an electrically adjustable control element 3, such as a thermostatic valve. An output of control element 3 is connected through another line 7 and input E of engine 1, to the cooling system of engine 1. Another output of control element 3 runs through a line 8 to the input of a radiator 2. The output of radiator 2 in turn is connected through a coolant line 9 with input E of engine 1.

The electrically adjustable thermostatic valve 3 has a temperature-dependent element made of expandable material that can be heated by an electrical line connected to an electronic control device 4. Such electrically adjustable thermostatic valves are well known in the art. See for example, German patent document DE 43 24 178 A1 and the corresponding allowed U.S. patent application Ser. No. 08/277,004. In the drawing, control element 3 is shown during warmup operation, with the left opening completely closed and the right opening completely open. Thus the coolant returns from output A of engine 1 in a short circuit through control element 3 via lines 6 and 7, directly to input E of engine 1. Radiator 2 is therefore bypassed by the coolant. During radiator operation, on the other hand, the right opening of control element 3 would be completely closed and the left opening would be completely open so that coolant flows through the radiator and back to the engine 1, via lines 6, 8 and 9. To maintain a desired set coolant temperature $T_{set}$, mixed operation is also possible, with both the right-hand and left-hand openings of control element 3 partially open. The control signal of control element 3 is a pulse-width-modulated control signal PWM.

According to the invention, the electronic control device 4 shown in the Figure is preferably a separate PID regulator. However, it is also possible to integrate the regulator as a functional assembly into an electronic control device that is provided in any case, for example for controlling the internal combustion engine and/or the cooling system. PID control 4 receives as input signals, at least the actual coolant temperature $T_{actual}$ and the selection of a set coolant temperature $T_{set}$. Depending on the currently set parameters of PID control 4, a corresponding pulse width modulated control signal PWM is generated as a set signal value, and is output by PID control 4 for electrical heating of control element 3. Such PWM feedback controls are also well known to those skilled in the art. See, for example, U.S. Pat. No. 4,955,431.

If the control signal PWM is a pulse-width-modulated signal, this control signal PWM itself (thin line) can possibly be used as step excitation SE'. However, the pulse should have a preset minimum duration within the period $T_{pwm}$. Otherwise a pulse specially created for the purpose (heavy line) is used as step excitation SE, for example with a preset duration $t_{SE}$.

In response to step excitation SE or SE', step response SA (for example for a preset interval) is detected and evaluated with respect to the actual coolant temperature $T_{actual}$. The parameters of PID control 4 are adjusted in accordance with the evaluation of the step response SA of control element 3 and/or control section 5. For this purpose, step response SA is evaluated for example with regard to its dead time $T_{dead}$ and/or its slope dT/dt. (To evaluate step response SA, however, other characteristics of the curve of step response SA can be considered.) So called "adaptive controllers" suitable for this purpose are known and are commercially available, such as for example, the West 2071 Microtuner by Gulton.

By evaluating the step response SA to the step excitation SE, the influence of all operating parameters and disturbing parameters acting on PID control 4, control element 3, and/or control section 5 are automatically taken into account. As a result, an increase in both control quality and speed is achieved while eliminating the need for more sensors to record additional operating parameters or disturbing parameters. By means of the cooling system according to the invention, both consumption and power are also optimized under the stated operating conditions.

However, the invention is not limited to the embodiment named hereinabove. For example, instead of (or in addition to) the thermostatic valve 3, the electrically and/or electronically adjustable control element may comprise a coolant delivery or even an electrically controllable coolant throttle valve arranged in the coolant circuit. Basically, the invention covers every control element that can be controlled electrically or electronically to influence coolant temperature. In addition, the control signal value need not necessarily be a pulse-width-modulated signal. Rather, depending on the design of the control element, it can also be any kind of suitable electrical signal, such as for example a voltage signal proportional to adjustment travel or a frequency-modulated pulse.

In addition, rather than the coolant temperature itself, a value influenced by the coolant temperature (for example, another temperature, such as that of a part traversed by the coolant) can be used for control purposes according to the invention.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cooling system for an internal combustion engine, comprising:

an electrically adjustable control element to influence the coolant temperature of the internal combustion engine;

an adaptive electronic regulator for controlling operation of said control element, said regulator providing a control signal for controlling the control element to achieve a set coolant temperature, at least as a function of a value influenced by actual coolant temperature, said function being variable in accordance with operating parameters of the regulator;

wherein said operating parameters of the regulator are determined on an ongoing basis during engine operation, without interrupting control of said control element by said regulator, as a function of a response of a value proportional to the actual coolant temperature, to a step excitation as an input signal of control element.

2. Cooling system according to claim 1 wherein step excitation is contained within the control signal for controlling the control element itself.

3. Cooling system according to claim 2, wherein the control signal is a pulse-width modulated signal.

4. Cooling system for an internal combustion engine comprising:

a radiator;

coolant lines for conducting a flow of coolant between said radiator and said internal combustion engine;

an electrically controlled valve for controlling a flow of coolant from said engine through said radiator;

means for inputting a desired set temperature;

means for detecting a quantity proportional to an actual temperature of said engine coolant;

an adaptive control unit for controlling said electrically controlled valve in response to said actual temperature and said set temperature, said control unit having operating parameters which define a functional relationship between an output control signal of said control unit and temperature values input thereto;

wherein said operating parameters are determined on an ongoing basis without interrupting control of said control element by said control unit, as a function of a response of said quantity proportional to said actual temperature to a step excitation of said control unit.

5. Cooling system according to claim 4 wherein said control unit is a PID element.

6. A method of operating a temperature control system for an engine coolant in an internal combustion engine, said temperature control system comprising an electrically adjustable control element to influence coolant temperature, a sensor for determining a value of a variable which is indicative of said coolant temperature, and an adaptive electronic regulator for controlling operation of said control element, said regulator providing a control signal for controlling the control element to achieve a desired coolant temperature as a function of said value of said variable, said function being dependent upon processing parameters of said electronic regulator, said method comprising the steps of:

stimulating said temperature control system by means of an input step function;

evaluating a step response of said temperature control system to said input step function; and adjusting values of said processing parameters of said electronic regulator during engine, operation as a function of said response of said temperature control system to said input step function;

wherein said steps of stimulating, evaluating and adjusting are performed on an ongoing basis during engine operation, without interrupting control of said control element by said regulator.

7. Method according to claim 6, wherein said electronic regulator comprises a PID element, and wherein said adjusting step comprises adjusting at least one processing parameter of said PID element.

8. The method according to claim 6, wherein said step function is contained within the control signal for controlling the control element.

9. A cooling system for an internal combustion engine, comprising:

an electrically adjustable control element to influence the coolant temperature of the internal combustion engine;

an adaptive electronic regulator for controlling operation of said control element, said regulator providing a control signal for controlling the control element to achieve a set coolant temperature, at least as a function of a value influenced by actual coolant temperature, said function being variable in accordance with operating parameters of the regulator; wherein the regulator is arranged to simulate during engine operation a relationship between an input of the control element and an output of the cooling system and is further arranged to adjust automatically said operating parameters of the regulator to take account of at least one parameter which affects said relationship; and automatic adjustment of said operating parameters is performed on an ongoing basis during engine operation, without interrupting control of said control element by said regulator.

10. The cooling system according to claim 9, wherein adjustment of said operating parameters is based on a response of said quantity proportional to said actual temperature, to a step excitation that is contained in said control signal.

11. Cooling system for an internal combustion engine, comprising:

an electrically adjustable control element to influence the coolant temperature of the internal combustion engine;

an adaptive electronic regulator for controlling operation of said control element, said regulator providing a control signal for controlling the control element to achieve a set coolant temperature, at least as a function of a value influenced by actual coolant temperature, said function being variable in accordance with operating parameters of the regulator;

wherein said operating parameters of the regulator are varied during engine operation, as a function of changing operating conditions of said vehicle, on an ongoing basis without interrupting control of said control element by said regulator.

12. The cooling system according to claim 11, wherein variation of said operating parameters is based on a response of said value influenced by actual coolant temperature, to a step excitation that is contained in said control signal.

13. Cooling system for an internal combustion engine comprising:

a radiator;

coolant lines for conducting a flow of coolant between said radiator and said internal combustion engine;

an electrically controlled valve for controlling a flow of coolant from said engine through said radiator;

means for inputting a desired set temperature;

means for detecting a quantity proportional to an actual temperature of said engine coolant;

an adaptive control unit that generates a control signal for controlling said electrically controlled valve in response to said actual temperature and said set temperature, said control unit having operating parameters which define a functional relationship between an output control signal of said control unit and temperature values input thereto;

wherein said operating parameters are determined as a function of changing operating conditions of said cooling system and engine during operation of said engine, on an ongoing basis without interrupting control of said control element by said control unit.

14. The cooling system according to claim 13, wherein determination of said operating parameters is based on a response of said quantity proportional to actual temperature of said engine coolant, to a step excitation that is contained in said control signal.

* * * * *